United States Patent [19]

Gottsmann et al.

[11] 4,365,900

[45] Dec. 28, 1982

[54] PRINTING PLANE ADJUSTING MECHANISM

[75] Inventors: Helmut Gottsmann, Nuremberg; Rolf Theilen, Furth, both of Fed. Rep. of Germany

[73] Assignee: Triumph Adler, A.G., Nuremberg, Fed. Rep. of Germany

[21] Appl. No.: 193,394

[22] Filed: Oct. 2, 1980

[30] Foreign Application Priority Data

Jun. 3, 1980 [DE] Fed. Rep. of Germany ..... 3008539

[51] Int. Cl.[3] ..... B41J 11/20

[52] U.S. Cl. ..... 400/57; 400/58; 400/653

[58] Field of Search ..... 400/55, 56, 57, 58, 400/59, 60, 649, 648, 653, 660, 660.2; 74/10.9

[56] References Cited

U.S. PATENT DOCUMENTS

| | | | |
|---|---|---|---|
| 693,033 | 2/1902 | Knapp | 400/348 |
| 1,175,886 | 3/1916 | McLaughlin | 400/57 |
| 1,319,428 | 10/1919 | Spiro | 400/660.2 |
| 1,906,304 | 5/1933 | Barrett | 400/58 X |
| 2,566,963 | 9/1951 | Ritz | 400/57 |
| 2,986,259 | 5/1961 | Salzberger | 400/59 X |
| 3,442,210 | 5/1969 | Hawxhurst | 400/56 X |
| 4,178,106 | 12/1979 | Mailer et al. | 400/57 |
| 4,286,888 | 9/1981 | Bennett et al. | 400/55 |

FOREIGN PATENT DOCUMENTS

| | | | |
|---|---|---|---|
| 701785 | 1/1965 | Canada | 400/59 |

*Primary Examiner*—Edgar S. Burr
*Assistant Examiner*—Charles Pearson
*Attorney, Agent, or Firm*—Joseph R. Spalla

[57] ABSTRACT

Disclosed is a printing plane adjusting mechanism for a typewriter or similar machine wherein a paper handling system including a platen defining the printing plane is finely as well as coarsely adjustable by a single lever relative to a printing element to establish a predetermined normal distance between the printing plane and printing element or varied distances other than normal to accommodate paper packs of varying thickness. Adjustment of the normal distance or gap is effected without loosening or tightening screws.

2 Claims, 1 Drawing Figure

PRINTING PLANE ADJUSTING MECHANISM

Figure 1:
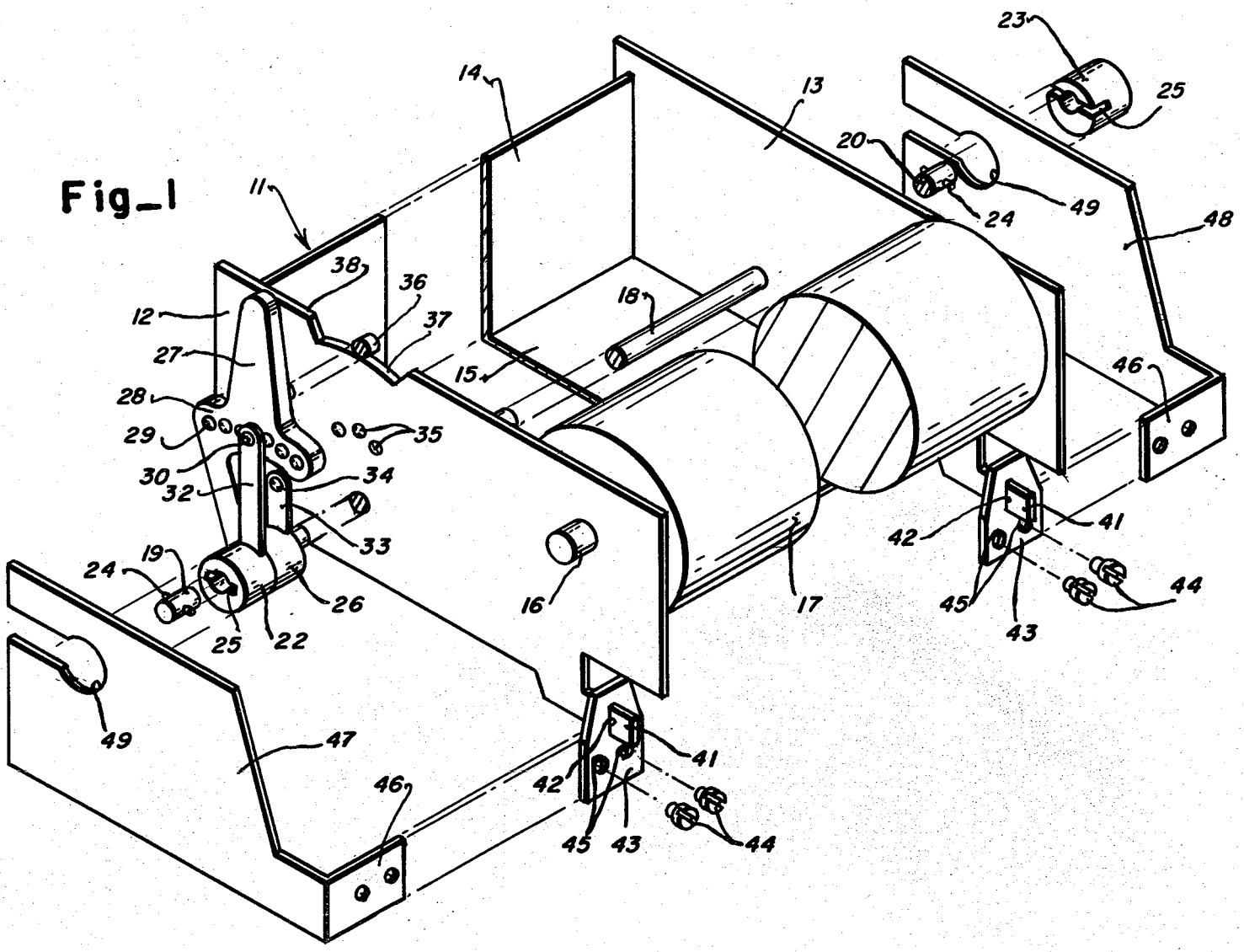

The invention relates to a printing plane adjusting mechanism for typewriters and similar office machines; more particularly it relates to such a mechanism for initially setting the printing plane a predetermined distance from a printing element and for adjusting the printing plane from said predetermined distance according to paper pack thickness; and specifically it relates to such a mechanism having a rotatable control shaft arranged to carry the printing plane and having at its ends eccentric cams mounted in stationary frame side walls to move the printing plane relative thereto.

In a prior art printing plane adjusting mechanism e.g. German Pat. No. 111,850 sliding blocks, in one embodiment, are displaceably mounted on control plates which are adjustable by means of eccentric cams to fix both the normal horizontal and the vertical printing plane positions. The control plates are joined with the side wall of the machine frame by screws and adjustment of the printing plane to accommodate different paper pack thicknesses is effected by turning the eccentrics which engage openings in the control plates. As the axis of the printing plane is rigidly connected with the eccentrics, this arrangement is not suitable for a rotating platen.

In another embodiment a control shaft is provided that carries eccentrics rigidly connected with it. When the control shaft is rotated by hand, the printing plane is adjusted horizontally. In order to prevent inadvertment adjustment, friction disks are provided in the first embodiment between the printing plane and the sliding blocks while in the second embodiment a control ring with compression spring on the adjusting axis is necessary.

In this noted prior art a disadvantage resides in the fact that only the printing plane is adjusted without affecting the related assemblies, i.e. the paper trough, paper guide, etc., and further the arrangement is very elaborate in terms of the number of parts and the assembly thereof.

In accordance with the invention a paper handling assembly including a platen, paper guides, paper insert and line spacing mechanism, is adjustably movable as a unit relative to a frame supporting a printing mechanism or element to adjust the distance or gap between the platen and printing element. A shaft having eccentric ends supported in the frame extends through the paper handling assembly and when rotated moves the paper handling assembly. A lever is provided on the shaft which is angularly adjustably connected to an arm extending from the eccentric to establish a predetermined gap. Thereafter the lever is employed to rotate the eccentrics to adjust the gap for different paper thicknesses.

An object of the invention is to provide a simple and reliable printing plane adjusting mechanism.

Another object of the invention is in the provision of printing plane adjusting mechanism wherein the normal printing gap can be set during assembly of the paper handling assembly and which can be adjusted after the assembly is mounted in a machine to vary the printing gap for different paper thicknesses.

Another object of the invention is to provide a simple and reliable printing plane adjusting mechanism wherein the desired normal gap can be preset by simply changing the angular orientation between two parts without the necessity for loosening and tightening screws.

Other objects, features and advantages of the present invention will become known to those skilled in the art from a reading of the following detailed description when taken in conjunction with the accompanying drawing wherein like reference numerals designate like or corresponding parts throughout the several views thereof, and wherein:

The single FIGURE is an exploded prospective view of a paper handling assembly mounted on a machine frame for adjustment as a whole relative to the machine frame.

Referring now to the drawing there is shown in FIG. 1 a paper handling assembly generally designated by reference numeral 11 comprising a frame having left and right side walls 12, 13 connected by a rear wall 14 and a bottom wall 15. A central shaft 16 of a platen 17 defining a printing plane extends through and is rotatably supported by the side walls 12, 13. Also, extending through the side walls is a control shaft 18 which at its ends 19 and 20 outwardly of the side walls 12, 13 is non rotatably coupled to eccentric bushings 22, 23 as by oppositely extending radial pins 24 which enter into complimentary slots 25 extending radially from the bore in the eccentric bushings 22, 23. Inwardly of the left eccentric bushing 22, the control shaft 18 rotatably supports the hub 26 of an adjusting lever 27 which extends radially therefrom. The adjusting lever 27 is formed with an arcuate portion 28 intermediate its ends having a plurality of angularly spaced detent holes 29 adapted to receive a locking detent 30 on the end of a lever arm 32 extending radially from the eccentric 22 on the left end of the control shaft 18. During assembly, the angular orientation of the adjusting lever 27 with respect to the eccentric 22, according to the predetermined desired normal distance between platen 17 and printing element (not shown), is established. The hub 26 of the adjusting lever 27 is also provided with a radially extending arm 33 having at its end a detent 34 adapted to engage angularly spaced detent holes 35 in the left side wall 12 according to the angular position of the adjusting lever 27. Movement of the adjusting lever 27 is guided by an axially extending pin 36 on the adjusting lever 27 which cooperates with an arcuate guide surface 37 on the upper edge 38 of the left side wall 12.

As will be understood the paper handling assembly 11 also supports paper guides, paper injection and line feed mechanism (not shown).

As shown in FIG. 1 the lower forward ends of the side walls 12 and 13 have forwardly extending projections 41 for entry into and for movement relative to guide slots 42 in plates 43 which are vertically adjustably secured, as by screws 44 extending through elongated holes 45 in the plates, to bent in ends 46 of left and right side plates 47, 48 of a machine frame whereon a printing element forwardly of the platen 17 is supported.

The machine side plates 47, 48 are provided with holes 49 to rotatably support the eccentrics 22, 23 on the ends 19, 20 of the control shaft 18 so that when the adjustable lever 27 is rocked it rotates the eccentrics 22, 23 and control shaft 18 through eccentric lever arm 32 causing the paper handling assembly 11 to move as a whole relative to the machine frame plates 47, 48, and the platen 17 carried thereby relative to the printing mechanism according to paper pack thickness.

The disclosed adjusting mechanism is particularly suited to machines with single element type balls or discs supported on a carriage for movement in writing and return directions relative to the platen 17 but it is to be understood that it may be adapted to machines wherein the paper handling assembly including the platen 17 is supported on a carriage moveable relative to a fixed printing mechanism. In the latter case frame side plates 47, 48 would be carriage end plates.

The invention claimed is:

1. In combination, a paper handling assembly having side plates, a platen defining a printing plane rotatably supported between said side plates, a control shaft rotatably supported by said paper handling assembly side plates, a frame member for mounting said paper handling assembly having side plates outwardly of said paper handling assembly side plates, circular cams eccentrically mounted on the ends of said control shaft, circular openings in said frame member side plates for rotatably supporting said cams when said paper handling assembly is mounted on said frame member, one of said cams having an arm radially extending therefrom, an adjusting lever rotatably mounted on said control shaft adjacent said arm, locking detent means on said arm and said lever for adjustably locking said lever to said arm at a predetermined angular orientation thereby, when said said paper handling assembly is mounted on said frame, to establish a predetermined normal position of said paper handling assembly relative to said frame member, and handle means on said lever for rotating said lever and via said arm said control shaft to adjustably position said paper handling assembly relative to said frame member.

2. The combination recited in claim 1, further including means for establishing the vertical orientation of and for guiding movement of said paper handling assembly relative to said frame member comprising lugs extending forwardly from said paper handling assembly side plates, and brackets vertically adjustably secured to said frame member side plates, said brackets having slots to support and to guide said lugs during adjusting movement of said paper handling assembly relative to said frame member.

* * * * *